US005613308A

United States Patent [19]

Little

[11] Patent Number: 5,613,308

[45] Date of Patent: Mar. 25, 1997

[54] DOOR BRAKE

[75] Inventor: Alexander R. Little, Mackay, Australia

[73] Assignee: Marlene J. Little, Australia; a part interest

[21] Appl. No.: 518,982

[22] Filed: Aug. 24, 1995

[30] Foreign Application Priority Data

Aug. 26, 1994 [AU] Australia ..... PM7706

[51] Int. Cl.[6] ..... E02F 3/407

[52] U.S. Cl. ..... 37/445; 37/444; 414/726; 16/375; 16/86 C; 74/526; 267/154

[58] Field of Search ..... 37/445, 444; 16/374, 16/375, 86 R, 86 A, 86 B, 86 C; 414/726; 464/78, 182, 179; 74/526, 607; 267/273, 279, 154

[56] References Cited

U.S. PATENT DOCUMENTS

| | | | |
|---|---|---|---|
| 1,629,634 | 5/1927 | Orndorff | 37/444 |
| 1,637,689 | 8/1927 | Endersby | 37/444 |
| 1,712,040 | 5/1929 | Houghton | 414/726 |
| 2,016,032 | 10/1935 | Burke | 414/726 X |
| 2,160,432 | 5/1939 | Davidson | 414/726 X |
| 2,335,352 | 11/1943 | Murtaugh | 16/86 A |
| 2,476,182 | 7/1949 | Davidson | 16/86 C |
| 2,604,221 | 7/1952 | Edwards et al. | 414/726 X |
| 2,638,620 | 5/1953 | Civitelli | 16/86 B |
| 2,694,319 | 11/1954 | Johnson | 267/154 |
| 2,724,518 | 11/1955 | Charlton et al. | 414/726 X |
| 2,735,559 | 2/1956 | Burdick et al. | 414/726 X |
| 2,840,253 | 6/1958 | Thompson | 414/726 X |
| 2,986,770 | 6/1961 | Hammond | 267/154 X |
| 3,059,793 | 10/1962 | Atkinson et al. | 414/726 |
| 3,135,012 | 6/1964 | Wessel | 16/86 B |
| 3,174,179 | 3/1965 | Benson | 16/86 B |
| 3,187,372 | 6/1965 | Parsons | 16/86 B |
| 3,857,298 | 12/1974 | Case et al. | 74/526 X |
| 4,006,832 | 2/1977 | Auxer et al. | 37/445 |
| 4,517,756 | 5/1985 | Olds et al. | 37/444 |
| 4,571,775 | 2/1986 | Leonard | 267/154 X |
| 4,858,273 | 8/1989 | Civitelli | 16/86 A |
| 5,237,724 | 8/1993 | Lee | 16/86 B |

FOREIGN PATENT DOCUMENTS

| | | | |
|---|---|---|---|
| 713949 | 2/1980 | U.S.S.R. | 37/445 |

*Primary Examiner*—Randolph A. Reese
*Assistant Examiner*—Thomas A. Beach
*Attorney, Agent, or Firm*—Remy J. VanOphem; Thomas A. Meehan; John VanOphem

[57] ABSTRACT

A door brake assembly (20) to control the closing of a dipper door (11) on a shovel dipper (10) has a torsion bar (39) connected to the dipper door (11) by links (15, 32). A lever (48) on the other end of the torsion bar (39) selectively engages spaced snubbers (57, 58) to provide a braking (or damping) action to the dipper door (11) in the last portion of its travel to the open or closed position. The torsion bar (39) is mounted in journals (23, 24, 43, 44) on a base (22) mounted on the dipper (10). Usually, each dipper door (11) is provided with a pair of the brake assemblies (20) mounted in mirror image.

8 Claims, 4 Drawing Sheets

DOOR BRAKE

BACKGROUND OF THE INVENTION

1. Field of the Invention

THIS INVENTION relates to a brake or damper assembly. The invention is particularly suitable for, but not limited to, a shovel dipper door brake.

2. Description of the Prior Art

At present, to control the swinging motion of the dipper door, manufacturers utilise snubber brakes.

These snubber brakes are mechanically connected to the door by link arms which, when the door opens and closes, transfer the door movement to two or more friction plates. These friction plates move fore and aft in the snubber assembly.

The snubber assembly consists of two fixed end friction plates, friction discs, a separator plate and two moving friction plates.

To create the braking effect on the door, the above components are pre-loaded by an adjusting nut, preloading a number of Belleville washers. The door is constantly under a braking effect during any motion, while all components are serviceable and correctly adjusted.

Failure to achieve the braking effect will cause the door to swing in an uncontrolled manner during the opening and closing operation.

Uncontrolled motion of the door will cause damage to the door and to the maximum travel stops during the opening travel, and will cause extensive damage to the door structure, latch bar, latch bar box and dutchman during the closing travel.

This mechanism is very susceptible to most types of climactic conditions, be it dry and dusty, wet, muddy, etc. and as a result, requires constant monitoring and adjustment which is labour intensive. Over adjustment will cause excessive component wear and under adjustment will result in dipper door and dipper component cracking and fatigue.

In some operations, adjustment could be as regular as once per day, resulting in considerable down time and loss of production. The adjustment time could be in the order of 30 to 40 minutes per shovel per day.

It will be stated by manufacturers that "our shovels do not require adjustment on a daily basis", and true, not all do, but on scheduled maintenance days, additional labor is required to carry out crack repairs, etc., to the door, which can be directly attributed to the poorly adjusted snubber brakes.

SUMMARY OF THE PRESENT INVENTION

Preferred objects of the present invention are to increase productivity by reducing mechanical downtime and excessive costly repairs by:

(a) controlling both ends of the door travel;

(b) not requiring adjustment between scheduled maintenance days;

(c) at least doubling or trebling major overhaul intervals; and (d) reducing the number of moving and wearing components by fifty percent (50%).

In one aspect, the present invention relates to a brake (or damper) assembly to control the movement of a first member, hingedly mounted on a second member, the first member being movable between a first position and a second position, the brake assembly including:

a base mountable on the second (or first) member;

a torsion bar or rod rotatably journalled on the base;

link means, connectable to the first (or second) member, on the torsion bar;

lever means on the torsion bar, spaced from the link means; and spaced stop means, on the second (or first) member, engageable by the lever means;

so arranged that when the lever means engages one of the stop means, a braking force is transmitted to the first (or second) member as the first member approaches the first or second position, respectively.

A pair of the link means may be provided on the torsion bar, with the lever means preferably intermediate thereof.

Preferably, the first member is a dipper door and the second member is a dipper.

The base may include respective spaced bracket assemblies mounted directly on the second member or via a base plate secured thereto.

Preferably, a first bracket assembly incorporates a hub, journalled in a pair of side plates, with a socket which receives one end of the torsion bar, and having the link means integral with, or secured to, the hub. Preferably, the distal end of the link means is connected to the dipper door links.

Preferably, a second bracket assembly has side plates in which the other end of the torsion bar is journalled. Preferably, the lever means are secured to (eg. by splines), or integral with, the torsion bar between the side plates.

Preferably, a pair of adjustable stops, eg. jacking bolts, are mounted on the second bracket assembly to limit the angular movement of the lever means (eg. to 30° to 45° travel). This, in turn, may provide a braking effect in the last, eg. 300–400 mm travel of the dipper door.

In a second aspect, the present invention resides in a shovel dipper fitted with the brake (or damper) assembly hereinbefore described.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENTS

Figure 1:
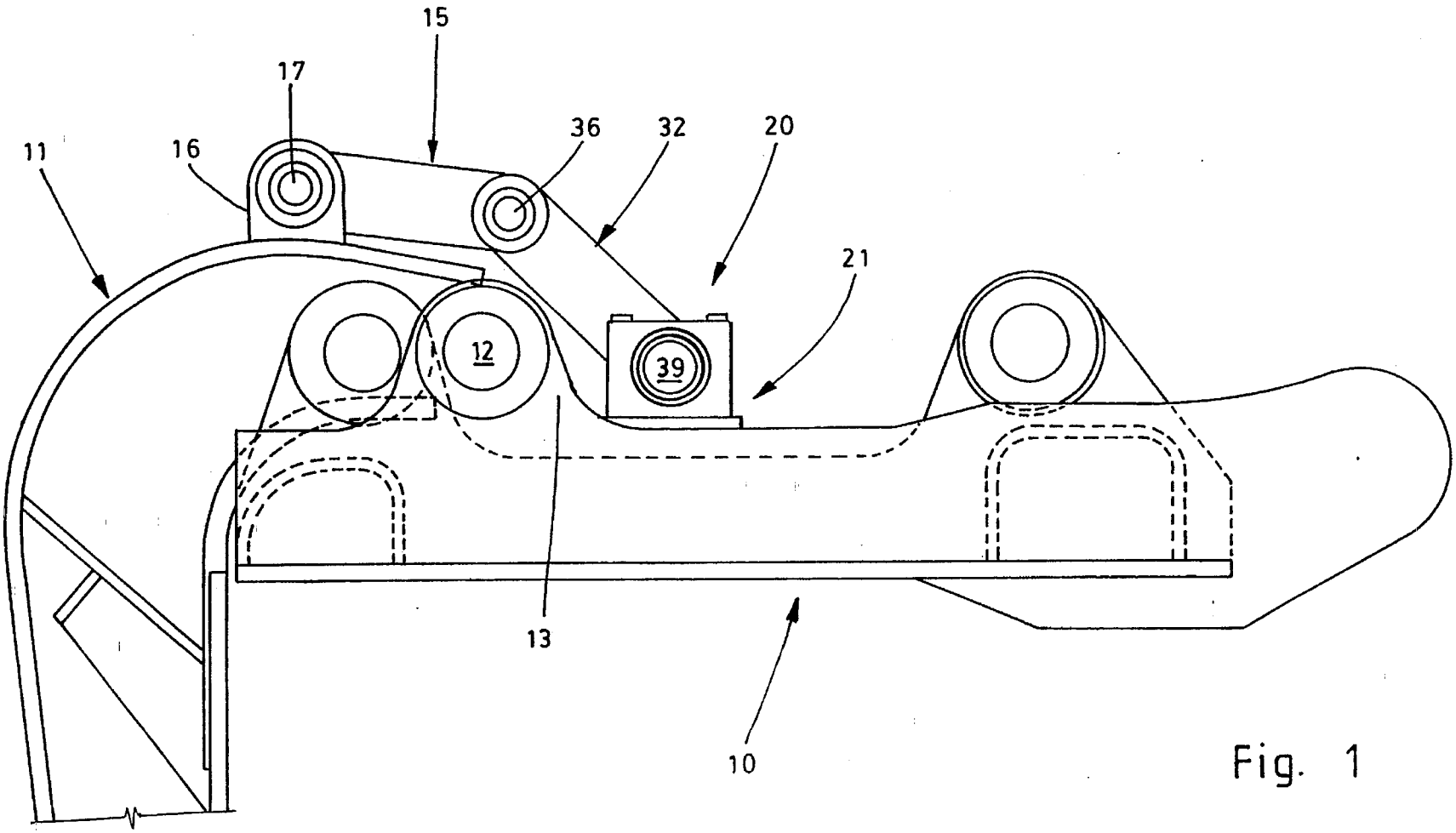
FIG. 1 is a schematic view showing the brake assembly of the present invention fitted to a shovel dipper, where the door is closed.
Figure 2:
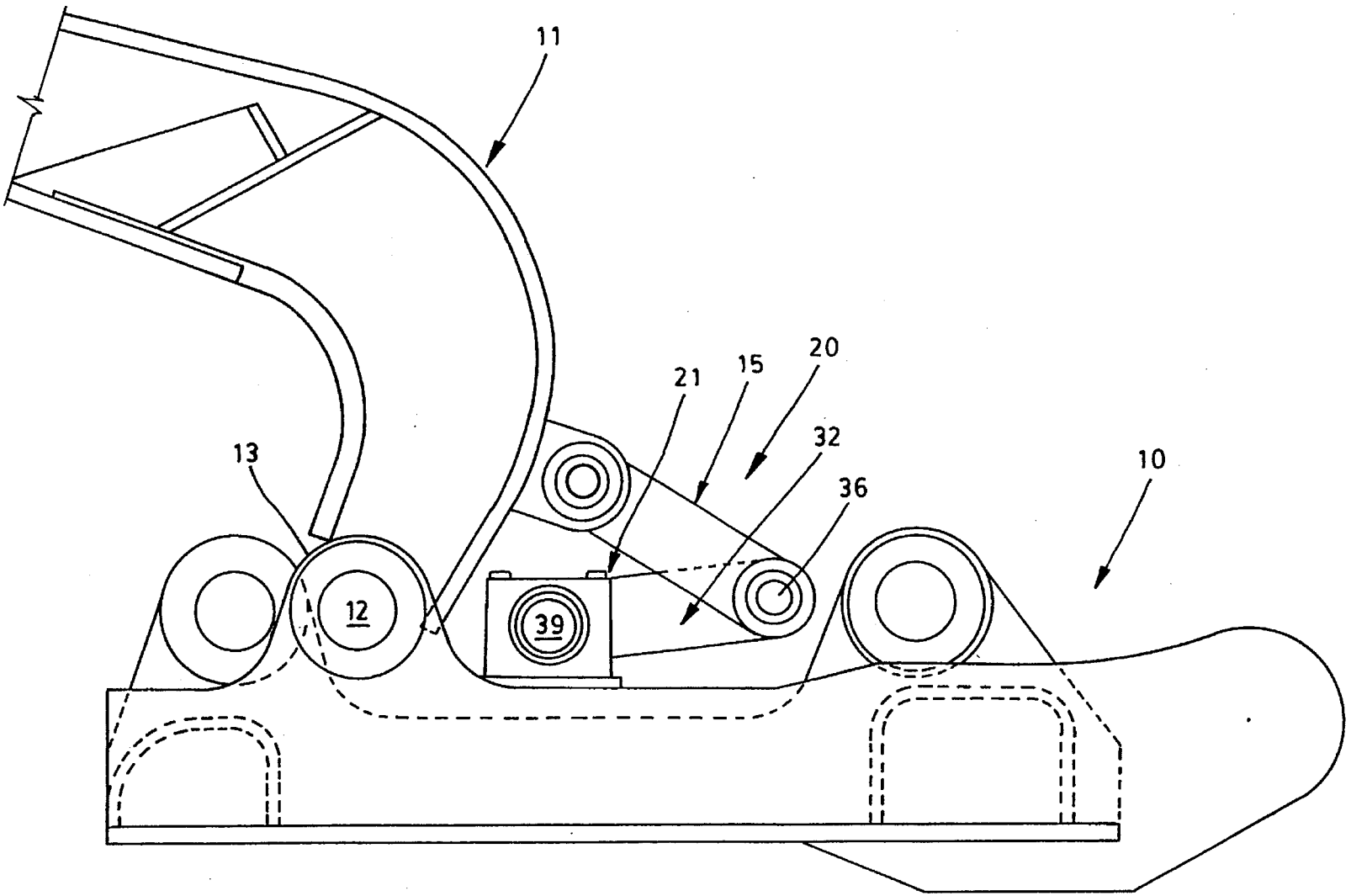
FIG. 2 is a similar view with the door open.

Referring to FIGS. 1 and 2, a shovel dipper 10 has a dipper door 11 hingedly mounted thereon via pivot pins 12 in hinge brackets 13.

Two sets of brake links 15 are hingedly mounted on the dipper door 11 via brackets 16 and pivot pins 17 to interconnect the dipper door to a pair of the brake assemblies 20 of the present invention, to be hereinafter described. The brake assemblies 20 are arranged as mirror images (see FIG. 3).

Figure 3:
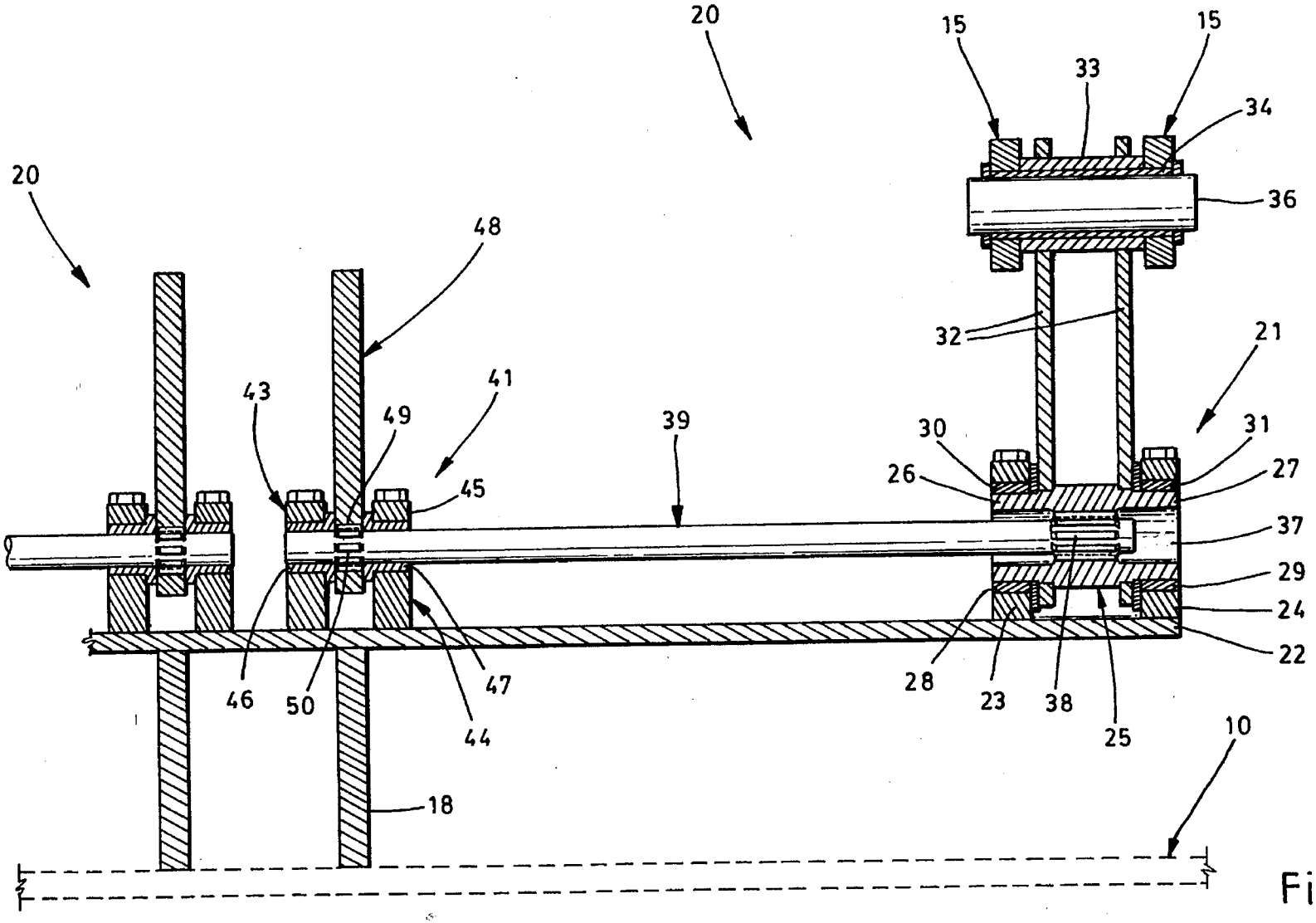
FIG. 3 is a sectional rear view of the brake assembly.

Referring to FIG. 3, the brake assembly 20 has a first bracket assembly 21 with a base 22 and journals 23, 24 welded or bolted to the dipper 10 via mountings 18.

A hub 25 has stub axles 26, 27, fitted with bushings 28, 29, journalled in complementary bushings 30, 31 in the journals 23, 24.

A pair of links 32, welded to the hub 25, have a tubular head socket 33, fitted with a bush to secure a pivot pin 36 to connect the link 32 to the brake links 15.

A splined socket 37 is provided in the hub 25 (coaxially with the stub axle 26) to receive a splined head 38 at one end of a torsion bar 39. A pad of polyurethane (or other resilient material), or Belleville springs, may be provided in the socket 37 to absorb any lateral movement of the torsion bar 39 relative to the hub 25.

A second bracket assembly 41, with journals 43, 44, is welded or bolted to the base 22, spaced from the first bracket assembly 21. The journals 43, 44 incorporate bearing caps 45 to support a thrust bushing 46 and split thrust bushing 47, respectively.

A lever 48, with a splined bore 49, is engaged with splines 50 on the torsion bar 39.

Figure 4:
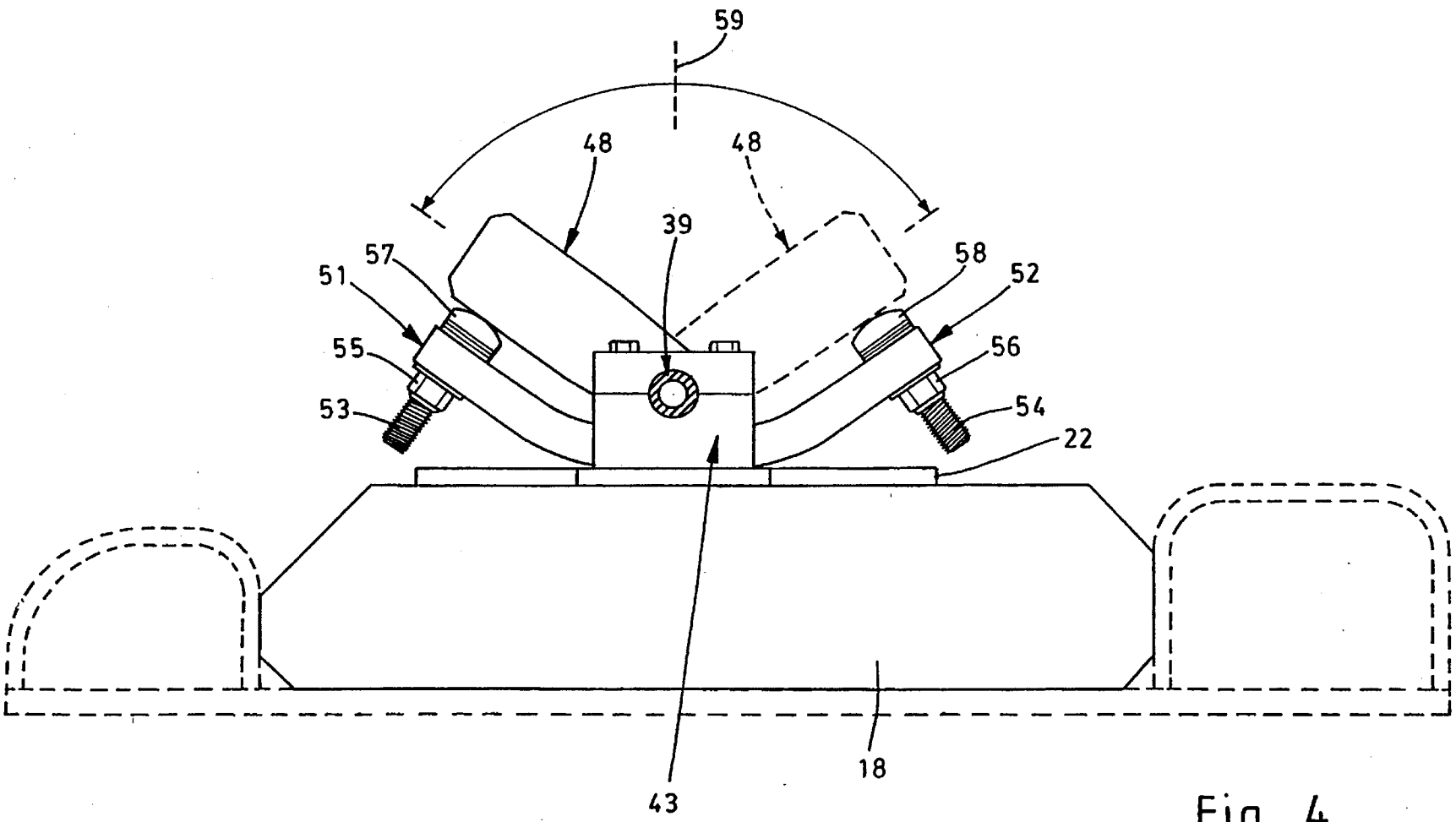
FIG. 4 is an end view of the brake assembly.

A pair of stop plates 51, 52 (see FIG. 4) are mounted on the base 22 and mount adjustable jacking bolts 53, 54 fitted with lock nuts 55, 56. As shown, the lever 48 has an angular travel of approximately 90°–120° which can be selectively set about a center line 59. The jacking bolts 53, 54 have rubber heads or snubbers 57, 58 engageable by the lever 48.

As hereinbefore described, the dipper door 11 is controlled by a pair of the (mirror image) brake assemblies 20 mounted on the dipper 10.

As the dipper door opens, its initial movement will be free but when it is approximately, eg. 300–400 mm from the maximum travel stops, the lever 48 will (gently) engage the snubber 58 on the jacking bolt 54. As the lever 48 can no longer rotate, but the link 32 is free to do so, the torsion bar 39 will twist and so provide a braking load on the dipper door 11.

Similarly, when the dipper door 11 is closing, the lever 48 will engage the snubber 57 on jacking bolt 53 before the dipper door 11 closes and so the torsion bar 39 will transfer a braking load to the link 32 (and thereby the brake links 15) to the dipper door 11.

By selective adjustment of the jacking bolts 53, 54, the opening and closing of the dipper door 11 can be accurately controlled. Any wear in the dipper door (or on the dipper 10) can be easily compensated for by adjustment of the jacking bolts 53, 54.

As the torsion bar 39 and hub 25 only rotate through limited angular travel, wear on the bushings 28, 29 and 46, 47 should be very low and so periodic maintenance should be low. Even if a torsion bar 39 should fail, it can be easily replaced.

In an actual operating mine, it has been calculated that dipper door maintenance, on a fleet of 5 shovels with 30 cubic yard dippers, resulted in an annual loss of production of over 3.4 million tons. Even a small reduction on dipper door maintenance is significant.

With the present invention, not only are the brake assemblies simpler to maintain, but their installation also reduces downtime for dipper/door maintenance/repair.

While the brake assemblies can be fitted to dipper doors of any size, they can also be applied to other installations where the movement of (heavy) hinged doors and gates or flaps must be controlled, eg. on hoppers, furnaces, shipping, etc.

Various changes and modifications may be made to the embodiments described and illustrated without departing from the scope of the present invention defined in the appended claims.

I claim:

1. A brake assembly to control the movement of a first member, said first member hingedly mounted on a second member, said first member being movable between a first position and a second position, said brake assembly comprising:

a base mounted to one of said first and second members;

a torsion bar rotatably journalled on said base, said torsion bar having one end mounted to one of said first and second members and an opposite end mounted to the other of said first and second members;

link means for pivotable movement with respect to said torsion bar, said link means having one end connected to one of said first and second members;

lever means for oscillatory movement with said torsion bar, said lever means being mounted to said torsion bar, said lever means being spaced from said link means and having one end connected to one of said first and second members; and spaced stop means for limiting the oscillatory movement of said lever means, said spaced stop means mounted to the other of said first and second members, said lever means engaging said stop means as said lever means oscillates between a first predetermined rotatable position and a second predetermined rotatable position opposite to said first predetermined position;

whereby as said lever means and second predetermined rotatable positions, said lever means is stopped oscillates and engages said stop means at one of said first while said torsion bar continues to rotate to generate and transmit a braking force to said link means.

2. A brake assembly as claimed in claim 1 wherein:

said first member is a shovel dipper door and said second member is a shovel dipper.

3. A brake assembly as claimed in claim 1 wherein:

said base further comprises respective spaced bracket assemblies mounted directly on said second member.

4. A brake assembly as claimed in claim 3 wherein one of said spaced bracket assemblies comprises:

a hub, journalled in a pair of side plates, with a socket which receives one end of said torsion bar, said link means being integral with said hub.

5. A brake assembly as claimed in claim 4 wherein:

the distal end of said link means is connected to dipper door links.

6. A brake assembly as claimed in claim 3 wherein:

another of said respective spaced bracket assemblies has side plates in which the other end of said torsion bar is journalled; and said lever means is secured to said torsion bar between said side plates.

7. A brake assembly as claimed in claim 6 wherein:

said stop means are jacking bolts mounted on said other of said respective spaced bracket assemblies, to limit the angular movement of said lever means such as to provide a braking effect in a last portion of travel to said dipper door.

8. A shovel dipper assembly including:

a shovel dipper as a first member;

a dipper door hingedly mounted on said dipper as a second member; and a brake assembly as claimed in claim 1.

* * * * *

UNITED STATES PATENT AND TRADEMARK OFFICE

CERTIFICATE OF CORRECTION

PATENT NO. : 5,613,308
DATED : March 25, 1997
INVENTOR(S) : Alexander R. Little

It is certified that error appears in the above-identified patent and that said Letters Patent is hereby corrected as shown below:

Column 4, line 28, after "means" insert ---- oscillates and engages said stop means at one of said first ---- .

Column 4, line 29, after "stopped" delete "oscillates and engages said stop means at one of said first".

Signed and Sealed this

Thirtieth Day of December, 1997

*Attest:*

*Attesting Officer*

BRUCE LEHMAN

*Commissioner of Patents and Trademarks*